United States Patent [19]

Jeans

[11] 4,328,909

[45] May 11, 1982

[54] CONTAINER FOR DISPENSING LIQUID UNDER CONSTANT HEAD

[75] Inventor: Edward L. Jeans, Ledbury, England

[73] Assignee: Cadbury Schweppes Limited, London, England

[21] Appl. No.: 125,287

[22] Filed: Feb. 27, 1980

[30] Foreign Application Priority Data

Feb. 28, 1979 [GB] United Kingdom ..... 7907048

[51] Int. Cl.[3] ..... B67D 5/28

[52] U.S. Cl. ..... 222/54; 222/481.5

[58] Field of Search ..... 222/481.5, 457, 442, 222/437, 464, 456, 445, 211, 212, 129.1, 54; 99/275

[56] References Cited

U.S. PATENT DOCUMENTS 2,738,105 3/1956 Wolfer et al. ..... 222/481.5 X

*Primary Examiner*—Stanley H. Tollberg

*Attorney, Agent, or Firm*—Kenyon & Kenyon

[57] ABSTRACT

A dispensing container comprising a wall, a base, and a top is used in an inverted condition and is closed, but for an outlet in the top from which liquid can be dispensed and an inlet to allow only sufficient air to bleed into the container to make up for liquid dispensed from the container so that the liquid will be dispensed from the container under constant head. In one arrangement, the inlet comprises a tube extending from the bottom to close to the top of the container with a one-way valve arrangement close to the bottom of the container to permit venting of the head space through the one-way valve arrangement in the event of a pressure build-up in the head space. In an alternative arrangement, the inlet comprises a tube extending from the top of the container to close to the bottom of the container and a valve closing flow of air through the tube, the tube permitting a flow of air to make up for material dispensed.

12 Claims, 8 Drawing Figures

CONTAINER FOR DISPENSING LIQUID UNDER CONSTANT HEAD

This invention relates to a dispensing container for liquid, said container having an outlet from which quantities of liquid can flow from the container, and a compensating inlet through which fluid, normally air, can flow to compensate for the quantities of liquid which in use flow from the container.

By the use of the container, it is possible, as will become clear hereinafter, to meter the flow of the liquid from the container so that either only a predetermined amount is dispensed at any one time or the amount which flows from the container at any one time can be as much or as little as desired (up to the limit of the capacity of the container) at the particular time. This possibility of use is of great benefit in the dispensing of flavouring syrups to be mixed with carbonated water to produce carbonated beverage, which is the main application of the invention in which we have an interest. It is to be mentioned however, that whilst the remainder of this specification refers only or mainly to carbonated beverages, the invention can be used for the dispensing of liquid of any nature.

It is of course well known that when one requires to dispense quantities of liquid from a sealed vessel, or an upturned vessel, from the lower end of the vessel it is necessary that some fluid has to be introduced into the interior of the vessel to compensate for the liquid dispensed. Thus, in the dispensing of measured quantities of alcoholic beverage spirit, such as whisky or gin, from the bottom of an inverted bottle, using what is referred to as an "optic" measuring device, when each quantity of spirit is dispensed, a compensating quantity of air is allowed to bubble up through the spirit in the bottle and make or increase the headspace above the spirit in the bottle. Automatically, only sufficient air is induced into the bottle to compensate for the volume of liquid displaced.

Apart from being expensive, optic measuring devices are usable only to meter predetermined quantities of liquid as dictated by the size of the optic chamber.

Persons concerned with the dispensing of metered quantities of syrup for the production of carbonated drinks have concerned themselves with the production of sealed packages or containers in which the syrup is contained, such containers being for attachment to a dispensing device somewhat similar to an optic measuring device in such manner to establish an outlet flow passage through which the syrup can flow to the measuring device and a venting passage whereby air can flow into the container in a quantity to compensate for the liquid which is dispensed from the container at each dispensing operation.

An example of a prior art package of the nature described above is described in British Pat. No. 1,537,699, in which a compensating vessel seals the outlet of the container. When the container is inverted and connected to a dispensing device communication between the interior of the container and the metering device is established, and there is also established communication between the interior of the compensating vessel and atmosphere. In the use of the package, because the interior of the package is sealed from the external atmosphere, and only sufficient air passes into the container to compensate for any liquid which flows out of the container, the outflow of liquid is under a constant head. This is desirable when the dispensing of the liquid is time controlled, as the quantity of liquid dispensed per unit time will be constant, but the effect is somewhat negated by virtue of the fact that the pacakge is used with a metering device. The package does have the advantage that free contact between the liquid therein and the atmosphere is avoided. This is an advantage in that if there is free contact between the atmosphere and the liquid, if it is a flavouring syrup, the liquid at the surface will with the passage of time, crystallise and sugar deposits will form on the inner wall of the container. These deposits are a source of bacteria growth which is unacceptable from a hygiene point of view. The package however, suffers from a disadvantage namely that only predetermined quantities of liquid in the container can be dispensed. That is to say, whilst the package can be used to dispense the right amount of syrup to produce a carbonate drink of say one cupful, if it is desired to dispense only sufficient syrup to produce half a drink, the system cannot be used without using a different metering device.

The present invention seeks to provide a dispensing container for liquids, such as flavouring syrups for carbonated drinks, which is readily capable of being used for the dispensing of predetermined or controlled random amounts of the liquid.

According to the invention, in one aspect, there is provided a package for the dispensing of liquid comprising a wall, a base and a top, the package being adapted for use in inverted condition and being closed but for an outlet in the top from which the liquid can flow under gravity and an inlet through which air can bleed to compensate for liquid which flows from the package, said inlet comprising a bleed tube extending from the bottom, i.e., base, of the container to a position close to the top of the container, and the tube having a one-way valve arrangement in the wall thereof adjacent the base of the container so that, in use, air in the head space in the container can be vented through the one-way valve arrangement in the event that the temperature of the air in said head space increases, but flow of air into said head space other than by bleeding through the vent tube is prevented so that dispensing of the liquid from the container will always be under a constant head.

In another aspect of the invention, the dispensing container is closed at the bottom end and at the top end or base there is an outlet from which the liquid in the container is dispensed, and there is a compensating inlet allowing the inflow of fluid into the container to compensate for the liquid which flows out of the container, the flow through the inlet being controlled by a valve which is responsive to the head of liquid in the container above the level of said valve when in use so that as long as there is any head of liquid in the container above the location of said valve, the valve will prevent inflow of compensating fluid unless the outlet is open allowing liquid to dispense from the container in which case the valve will open to allow inflow of compensating fluid, whereby the liquid will be dispensed under constant head.

Dispensing under constant head is important when dispensing takes place merely under gravity, because the dispensing rate will be substantially constant. These operating conditions are important when the liquid being dispensed is flavouring syrups for making carbonated drinks, because the ratio of carbonated water to flavoring syrup should be constant if satisfactory drinks are to be obtained repeatedly.

The said valve will preferably be embodied inside the container so as to come under the direct influence of the head of liquid in the container, and in one example the inlet comprises an inlet tube extending from the top of the container to close to the bottom of the container, the said valve being incorporated in said inlet tube at the top of the container. The valve may be defined by a partition wall blocking flow of fluid directly through the tube, said partition being located between two axially spaced holes in the tube, the holes being covered by a flexible membrane located outside the tube. When the container is in use, the head of liquid in the container presses the membrane against the tube wall sealing communication between said holes, and when the liquid flows from the container, said head of liquid reduces allowing only sufficient air to flow through said holes to form or add to a head space above the liquid sufficient only to compensate for the volume of liquid which flows from the container. In actual fact, when the compensating air flows through the valve, the membrane vibrates against the tube wall as opposed to being held clear of said holes. There are of course other forms of valve arrangements which can be used.

Embodiments of the invention will now be described by way of example, with reference to the accompanying diagrammatic drawings, wherein.

Figure 1:
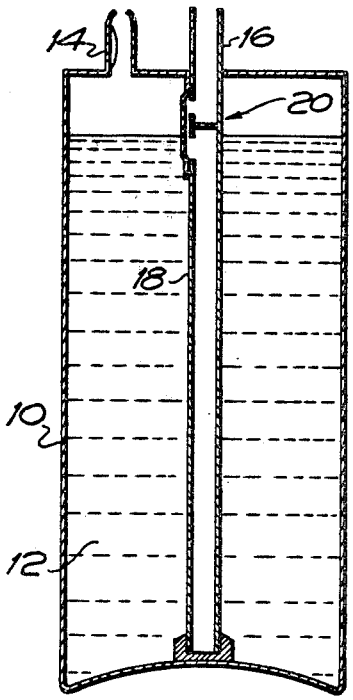
FIG. 1 is a sectional elevation of a container according to a first embodiment of the invention.
Figure 2:
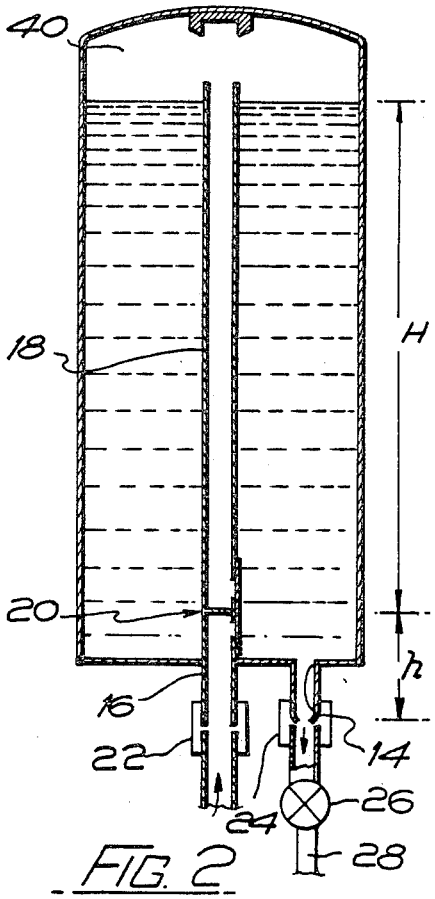
FIG. 2 shows in sectional elevation the container of FIG. 1 in the in use position.
Figure 5:
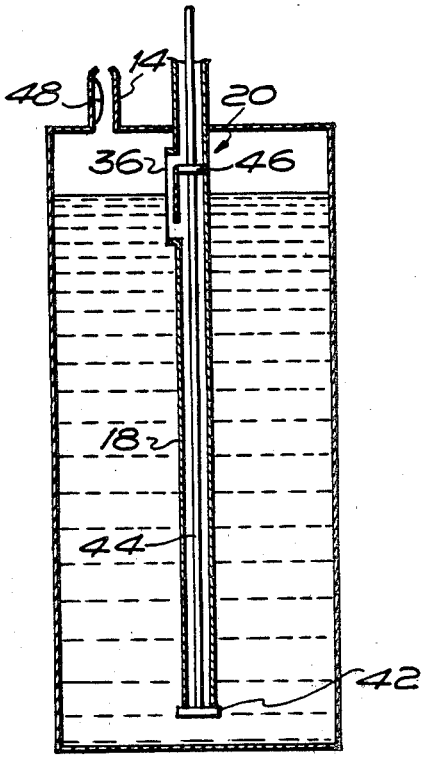
Figure 6:
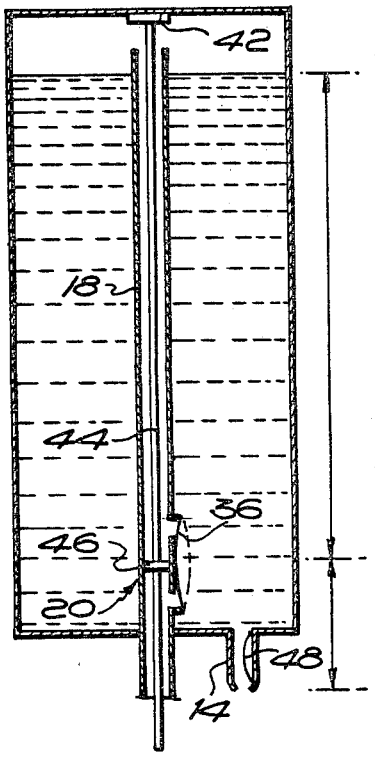
Figure 7:
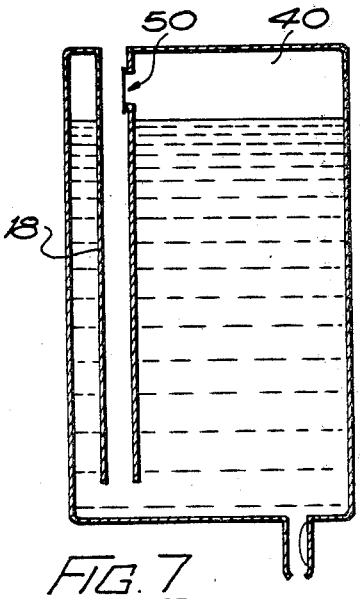
Figure 8:
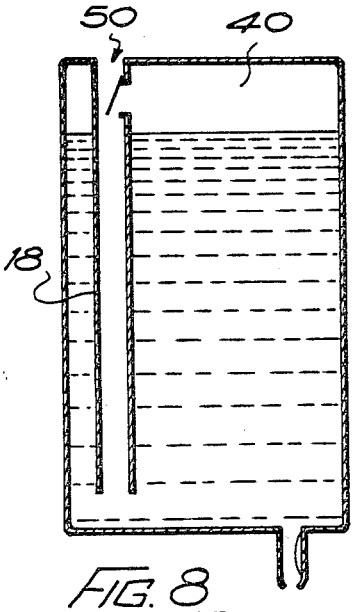

FIGS. 5 and 6 are views similar to FIGS. 1 and 2, but show a second embodiment of the invention; and FIGS. 7 and 8 are two views in section of a container according to another embodiment of the invention, the views showing the container in the in use position and respectively in two different operating conditions.

Referring firstly to FIGS. 1 to 4, in FIG. 1 there is shown a package or container for use in a machine for dispensing carbonated beverages. The machine may be for what is referred to as in-home use in the dispensing of individual carbonated drinks or it may be for use on a larger scale at locations such as sports grounds, cafeterias, public houses and offices. The container which is referenced 10 is a sealed unit and contains a quantity of flavouring syrup 12. FIG. 1 shows the container in the position in which it will be handled, transported or stored, whilst FIG. 2 shows the container in the in use position in which the container is inverted relative to the position shown in FIG. 1. At the end (the top end) which is in fact the lower end in the in use position, there is an outlet 14 from which the flavouring syrup is dispensed, and an inlet 16 through which a compensating fluid, in this case air, flows in order to compensate for the outflow of syrup from the container 10.

The inlet in fact consists of an inlet tube 18 which extends from the lower end of the container 10 to the top interior region as shown clearly in FIG. 1. The tube 18 embodies a valve 20 which is operated by the head of liquid 12 in the container 10 in a manner to be described herein.

In the use of the container 10 it would in fact be pluggedin two plug-in connections 22 and 24 provided on the machine. Connection 24 establishes communication between the interior of the package 10 and a control valve 26 of known construction, the operation of which controls the dispensing of the flavouring syrup from a discharge outlet 28. Liquid discharged from outlet 28 is mixed in any suitable fashion with carbonated water in order to produce a carbonated drink and the amount of syrup dispensed will be related to the quantity of carbonated water with which the syrup is mixed. The connection 22 may in fact connect the inlet pipe 16 to a supply of carbon dioxide gas under pressure if the package is to be operated with a pressurised system as opposed to a gravity system.

Figure 3:
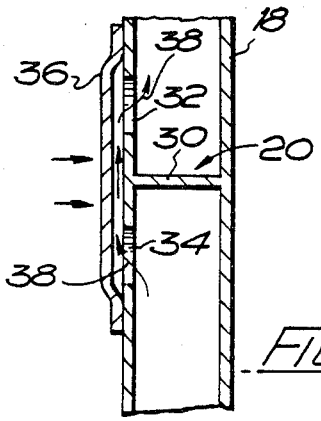
FIGS. 3 and 4 are enlarged sectional elevations of a detail shown in FIG. 1, showing the valve in the closed and open positions respectively.
Figure 4:
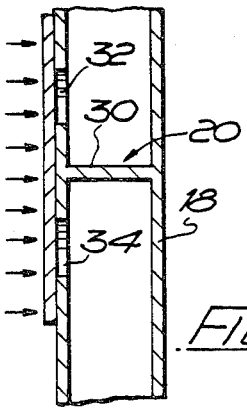

Referring now to FIGS. 3 and 4, the construction of the valve 20 is shown and it will be seen that this is defined by providing a partition 30 inside the tube 18 to block direct flow of fluid therethrough. Partition 30 is located between two axially spaced holes 32 and 34 in a wall of tube 18. These holes 32 and 34 are covered by a flexible membrane 36 which is sealed to the outer wall of tube 18, but permits communication between the holes 32 and 34 as shown by arrows 38 when there is no excess external pressure on the membrane 36. When there is such excess external pressure as indicated in FIG. 3, holes 32 and 34 are sealed and there is no flow of fluid through the pipe 18, and the valve is therefore closed.

By the arrangement described one achieves a constant head delivery of syrup to the outlet 14 and through the valve 26 and dispensing outlet 28, in that the valve 20 will in use operate automatically to compensate for the liquid which flows out of the package 10 when dispensing is taking place.

The device operates as follows:

Assume that the device is connected for gravity dispensing. Inlet 16 will be connected through connection 22 to astmosphere. If the valve 26 is closed then the valve 20 will be closed because the head of liquid H above the location of valve 20 inside container 10 prevents atmospheric pressure which exists in the lower portion of the tube 18 below the partition 30, from existing in the head space 40, and in fact by the nature of the operation of the system the pressure on membrane 36 applied through the liquid 12 is only sufficiently greater than atmospheric to keep the valve 20 closed. Assume that the valve 26 is now opened for the dispensing of a quantity of syrup from the container. Valve 26 may be opened for a predetermined length of time controlled by the machine control equipment as related to the flow of carbonated water or it may be operable manually for any desired length of time and when it is opened the tendency for the liquid in the container 10 to flow out of outlet 28 causes in effect a reduction in pressure in the head space 40 inside the container. The pressure of the head H exercised against the membrane 36 falls allowing the inflow of air past the membrane 36 as indicated in FIG. 3 and to the head space 40 thereby compensating automatically for the amount of liquid being dispensed. The pressure applied to the membrane 36 through liquid 12 will be approximately equal to atmospheric during this condition and, therefore, the head of the liquid flowing from the outlet 28 will be h and will be constant during flow. This occurs because when the valve 20 is open the pressure on the outside of membrane 36 is constant and is equal to atmospheric or slightly less. It will be understood from the above, that during this condition, the head space 40 is at a partial vacuum pressure.

Therefore, during flow of liquid out of the outlet 28 the head of such liquid will always be constant and this applies whether or not the device operates under gravity as described or operates with the inlet 16 connected to a source of fluid under pressure. The metering of the liquid from the device is controlled entirely by a relatively simple valve 26, which can be time operated for dispensing predetermined quantities and/or manually operated for dispensing desired but random quantities. This feature is particularly suitable for in-home applications. The device can be used with flavouring syrups of high Brix number because there is no free communication between the upper level of the syrup and atmosphere such as might give rise to excessive crystalisation inside the container. The container is a relatively simple unit which can be handled easily as regards it retailing and it can be fabricated in any suitable material, such as metal or plastics. It will be filled under controlled factory conditions and the coupling parts 22 and 24 may be one way valves which are only open when they receive a container 10 plugged into an appropriate machine.

As shown in the drawings, the free end of the tube 18 is sealed when the container is not in use, and this is achieved by making the base or bottom of the container capable of being deflected from the concave position shown in FIG. 1, to a convex position as shown in FIG. 2. When the base or bottom is in the concave position the free end of the tube 18 is sealed by means of a sealing ring, whereas when it is in the convex position the sealing ring is displaced from the free end of the tube and the free end of the tube is open to allow the container to function as described. The displacement of the bottom or base of the container between concave and convex positions is effected by the user, for example by pulling on an attachment on the base of the container.

In the embodiments shown in FIGS. 5 and 6, the container functions essentially in the same manner as the container already described except that the deflectible end is eliminated and the sealing of the free end of the tube 18 is achieved by means of a plug 42 which is connected to the end of a displacable stem 44 which is located inside the tube 18 and is slidable therein between the position sealing the end of the tube as shown in FIG. 5 and the position displaced from the end of the tube is shown in FIG. 6. When the stem 44 is displaced to the FIG. 6 position, which may occur automatically by virtue of the connection of the container to the machine, additionally a washer 46 moves into correct registration with the membrane 36 for the correct functioning (as described), of the valve 20. Stem 44 may be spring loaded so that it may be returned to the FIG. 5 position when the container is removed from the machine. In an alternative arrangement, the washer 46 is fixed and the stem 44 slides therein.

In the embodiment of the invention shown in FIGS. 7 and 8, the inlet tube 18 extends from the bottom or base of the container 10 to close to the top and adjacent the bottom of the container the tube 18 has a one-way valve arrangement 50 in the form of a flexible flap which covers an aperture in the wall of the tube 18. When the liquid 12 flows from the container 10, the valve 50 remains closed as shown in FIG. 7 and air is drawn into the container through tube 18 to compensate for the volume of liquid which flows from the container. Should the pressure in the head space 40 increase, as a result for example of an increase in the ambient temperature, gas from the headspace 40 will be vented through the valve 50 as shown in FIG. 8. Should the pressure in space 40 decrease, make-up air will be drawn in through the tube 18 so that a constant head can be maintained in the container and dispensing from the container will be under a constant head, in the same manner as hereinbefore described.

The embodiment of FIGS. 7 and 8 possesses a significant advantage that when it is in use if there is a rise in temperature such as might cause expansion of the gas in the head space then such gas will be vented through the one-way valve as regards FIGS. 7 and 8. This means that there will be a constant head on the discharge of liquid from the container regardless of the ambient temperature. Increases in temperature can however, effect the viscosity of the syrup inside the container and therefore the rate at which the liquid will flow out of the container if it flows out freely under gravity, which is an envisaged operation. To mitigate against the discharge of uneven quantities of liquid as a result of change of viscosity the outlet 14 in each embodiment is provided with a temperature sensitive restrictor 48 which operates to restrict the flow of liquid therethrough depending upon the ambient temperature. Such restrictor could be a bi-metallic strip which deflects to restrict the outlet 14 more or less depending upon the ambient temperature.

The containers according to the embodiment of the invention are cassette type containers in that they may be removed from the machine when the contents have only been partially consumed, and their places can be taken by other similar containers, but containing different flavouring syrups, the only possible servicing required being the cleaning of valve 26 and outlet 28.

It will be appreciated that the embodiments described are only examples and other arrangements are possible. For example the automatic compensating valve arrangements described herein can be used with containers of the type the subject of my co-pending application No. 140,698.

I claim:

1. A package for the dispensing of liquid comprising a wall, a base and a top, the package being adapted for use in inverted condition and being closed but for an outlet in the top from which the liquid can flow under gravity and an inlet through which air can bleed to compensate for liquid which flows from the package, said inlet comprising a bleed tube extending from the base of the container to a position close to the top of the container, said bleed tube open to the atmosphere at the base of said container and open to the inside of the container near the top thereof and the tube having a one-way valve arrangement in the wall thereof adjacent the base of the container, said one-way valve arrangement permitting passage of air only in a direction from inside said container, through said valve to the inside of said tube, so that, in use, air in the head space in the container can be vented through the one-way valve arrangement in the event that the temperature of the air in said head space increases, but flow of air into said head space other than by bleeding through the vent tube is prevented so that dispensing of the liquid from the container will always be under a constant head.

2. A package according to claim 1, wherein the one-way valve arrangement comprises a deflectible flexible flap which normally closes a vent aperture in the tube wall.

3. A package according to claim 1 and further including a temperature sensitive restrictor in said outlet to compensate for changes in viscosity due to changes in temperature.

4. A package according to claim 3 wherein said restrictor comprises a bimetallic strip.

5. In a package for the dispensing of liquid comprising a container having a wall, a base, and a top, said container adapted for use in the inverted condition, said container closed at the base, an outlet at the top of said container from which the liquid therein is dispensed and a compensating inlet permitting the inflow of fluid into the container to compensate for liquid which flows out of the container, the improvement comprising: an inlet tube having an inlet for coupling to a source of fluid, an outlet in communication with the head space above the liquid in said container, when said container is inverted, and a valve mechanism defined by a partition wall blocking flow of fluid directly through the tube, said partition being located between two axially spaced holes in the tube, the holes being covered by a flexible membrane located outside the tube, said valve located in said inlet tube near the top of the container such that it is responsive to the liquid head pressure existing near the top of said container when said container is in use in an inverted condition so as to maintain a constant head near the top of said container.

6. A package according to claim 5, wherein said compensating inlet comprises an inlet tube extending from the top of said container to near the base thereof, said inlet tube opening into the container near the base thereof and open to the source of compensating fluid at the top of said container, said valve comprising a valve disposed near the top of said container so as to come directly under the influence of the head of liquid in said container.

7. A package according to claim 6, wherein said valve is incorporated in said inlet tube.

8. A package according to claim 7, wherein said valve comprises: a partition wall in said tube blocking the flow of fluid directly through said tube; axially spaced holes in said tube on opposite sides of said partition; and a flexible membrane covering said holes located on the outside of said tube.

9. A package according to claim 5, and further including a temperature sensitive restrictor in said outlet to compensate for changes in viscosity due to changes in temperature.

10. A package according to claim 9, wherein said restrictor comprises a bimetallic strip.

11. In a package for the dispensing of liquid comprising a container having a wall, a base, and a top, the container adapted for use in the inverted condition and being closed at its base and having an outlet from which liquid in the container is dispensed at its top, and a compensating inlet permitting the inflow of fluid into the container to compensate for the liquid which flows out of the container so as to maintain an essentially constant pressure within said container, the improvement comprising: a temperature sensitive restrictor in the outlet to compensate for changes in viscosity due to changes in temperature.

12. The improvement according to claim 11, wherein said restrictor comprises a bimetallic strip.

* * * * *